US011369969B2

(12) United States Patent
Portal

(10) Patent No.: US 11,369,969 B2
(45) Date of Patent: Jun. 28, 2022

(54) CONE CRUSHING MACHINE AND CRUSHING METHOD USING SUCH A MACHINE

(71) Applicants: FIVES SOLIOS, Le Pecq (FR); FIVES FCB, Villeneuve D'Ascq (FR)

(72) Inventor: Jerome Portal, Villeneuve D'Ascq (FR)

(73) Assignees: FIVES SOLIOS, Le Pecq (FR); FIVES FOB, Villeneuve d'Ascq (FR)

( * ) Notice: Subject to any disclaimer, the term of this patent is extended or adjusted under 35 U.S.C. 154(b) by 104 days.

(21) Appl. No.: 16/489,007

(22) PCT Filed: Feb. 20, 2018

(86) PCT No.: PCT/FR2018/050391

§ 371 (c)(1),
(2) Date: Aug. 27, 2019

(87) PCT Pub. No.: WO2018/154222

PCT Pub. Date: Aug. 3, 2018

(65) Prior Publication Data

US 2020/0023372 A1 Jan. 23, 2020

(30) Foreign Application Priority Data

Feb. 27, 2017 (FR) ..... 17 51554

(51) Int. Cl.
*B02C 2/04* (2006.01)
*B02C 2/00* (2006.01)

(52) U.S. Cl.
CPC ..... *B02C 2/045* (2013.01); *B02C 2002/002* (2013.01)

(58) Field of Classification Search
CPC ..... B02C 2/045; B02C 2/04; B02C 2002/002; B02C 25/00
See application file for complete search history.

(56) References Cited

U.S. PATENT DOCUMENTS 3,434,672 A * 3/1969 Guin ..... B02C 2/10 241/194
5,575,428 A * 11/1996 Cordonnier ..... B02C 2/04 241/30

(Continued)

FOREIGN PATENT DOCUMENTS

CA 2136540 A1 9/1994
EP 0642387 3/1995

(Continued)

OTHER PUBLICATIONS

English translate (WO9315838A1), retrieved date Apr. 22, 2021.*

(Continued)

*Primary Examiner* — Jessica Cahill
*Assistant Examiner* — Mohammed S. Alawadi
(74) *Attorney, Agent, or Firm* — Nixon & Vanderhye

(57) ABSTRACT

A crushing machine includes: a frame, a tank, a cone placed inside the tank, the machine further including a device for vibrating the tank with respect to the frame; the machine being characterized in that the device for vibrating the tank includes at least two vibrators which are mounted on the frame, each vibrator being rotated about a longitudinal axis of the frame by a motor, each motor driving the vibrator with which it is associated independently from one another.

20 Claims, 4 Drawing Sheets

(56) References Cited

U.S. PATENT DOCUMENTS

| | | | | |
|---|---|---|---|---|
| 5,996,915 | A | 12/1999 | Cordonnier et al. | |
| 2011/0139913 | A1 * | 6/2011 | Fried | B02C 25/00 241/47 |
| 2011/0155834 | A1 | 6/2011 | Fan | |

FOREIGN PATENT DOCUMENTS

| | | | | |
|---|---|---|---|---|
| EP | 0833692 | | 4/1998 | |
| FR | 2687080 | | 8/1993 | |
| FR | 2735402 | | 12/1996 | |
| RU | 136744 | U1 * | 1/2014 | |
| WO | WO-9315838 | A1 * | 8/1993 | B02C 2/04 |
| WO | 9421380 | | 9/1994 | |
| WO | 2014/186821 | A1 | 11/2014 | |

OTHER PUBLICATIONS

English translate (RU136744U1), retrieved date Apr. 22, 2021.*
International Search Report—PCT/FR2018/050391—dated May 14, 2018.
Office Action issued in Indian Patent Application No. 201947033667 dated Aug. 31, 2021.

* cited by examiner

CONE CRUSHING MACHINE AND CRUSHING METHOD USING SUCH A MACHINE

BACKGROUND OF THE INVENTION

The invention relates to the field of fragmentation machines, also known as crushing and/or grinding machines for material, such as ores. More specifically, the invention relates to the field of crushing machines in which the material is crushed between a cone and a bottomless truncated cone tank by moving the tank with respect to the cone.

The operating principle of such machine is described in patent document FR 2687 080. The machine consists of a conical head, also called cone, housed in a tank, with a space that is defined between the head and the tank. The conical head is in a fixed position with respect to a frame, while the tank is positioned on a supporting structure, which is mounted floating with respect to the frame. The supporting structure can be moved in a horizontal plane with respect to the frame by means of vibrators that are set in movement by appropriate means. Thus, the material that is discharged into the space between the cone and the tank is crushed by the movement in circular translation in the horizontal plane of the tank with respect to the cone. The crushed material then falls into a conduit located under the cone.

The patent document EP 0 642 387 proposes two improvements. On the one hand, the conical head is mounted in free rotation about a vertical axis with respect to the frame, in order to reduce wear phenomena due to movements in a tangential plane between the tank and the head. On the other hand, the height of the cone with respect to the tank can be adjusted, so as to adjust the minimum width of the space between the head and the tank, and therefore the maximum size of the crushed products. Indeed, by measuring the rotation speed of the head, and by knowing the maximum width of the crushing space, it is possible to deduce the thickness of the material layer, and therefore the maximum size of the crushed products. By comparing this thickness with a set value, it is possible to adjust the machine parameters. The patent document EP 0 833 692 describes a system for vibrating the tank in order to reduce vertical vibrations. For this purpose, several vertical vibrator shafts are mounted on a frame supporting the tank, each shaft carrying a vibrator that is composed of two unbalanced weights disposed on either side of the frame base defining a horizontal plane. Thus, when the vibrators are rotated, the forces that they exert are located in the horizontal plane of the base.

In the examples presented above, the vibrating system includes vibrator shafts, usually four, arranged in a square pattern around the tank and the conical head. A first vibrator shaft is coupled to a motor, and the other shafts are driven from the first shaft by a set of pulleys and belt. The rotation of the vibrators must be synchronized to avoid the occurrence of spurious moments.

When starting the machine, the vibrating shafts are rotated, their speed increasing gradually to a nominal speed. The material that is discharged between the cone and the ring is then ground. However, without special precautions, the vibrations of the ring pass through different frequencies, some of which may correspond to harmonics frequencies of the machine, which is detrimental to the machine.

It is then known to set up a phase shifting device for adjusting the angular offset of one group of vibrators relative to the other group in order to modify the amplitude of the resultant of the forces generated by the vibrators. Thus, during the start-up, two vibrators are in phase opposition with respect to the other two vibrators so that the resultant of the forces generated by the vibrators is zero: the ring is immobile with respect to the cone. The phase opposition is maintained until the nominal speed is reached. Then, all the vibrators are phased, so that the resultant of the forces is maximum, and the ring is moved with respect to the cone to crush the material.

For example, as shown in patent document EP 0 833 692, the amplitude can be modified by means of one or two rotary hydraulic actuators making it possible to modify the phase shift of the vibrators of one group with respect to those of the other group. □Thus, the phase-shifting and phasing of the vibrators relative to each other rely in particular on the transmission by the assembly of pulleys and belts, making the adjustment imprecise and unreliable. Indeed, the wear of the pulleys and belts as well as the tension in the belts must be monitored in order to maintain a fine setting. The belt can also "jump" on the notches of the pulleys, especially since the notches are subject to wear, shifting the angular position of the vibrators with respect to each other.

In addition, the assembly of pulleys and belts increases the number of parts on the machine, making it more complex and making maintenance more difficult. In particular, the hydraulic cylinders for pivoting the shafts of the vibrators require a robust seal, not only with regard to the pivoting of the shafts, but also with regard to the vibrations of the machine. Many leakage problems can occur.

Furthermore, during machine operation, the hydraulic cylinders tend to rotate, in particular because of leaks that can be intensified by the vibrations of the machine, so that their position becomes random. Hydraulic cylinders cannot reliably hold an intermediate position. Thus, vibrators generally operate on an all or nothing principle: either the vibrators are out of phase, and the resultant of the forces is zero, or the vibrators are in phase, and the resultant is maximum. An intermediate position can only be held for a short period of time, in exceptional cases.

Nevertheless, it may be required to adapt the value of the maximum resultant as a setting of the general method. As this value cannot be adapted in a perennial way by maintaining an intermediate position through the cylinders, mechanical stops are manually installed in the cylinders in order to define a position giving the maximum resultant. Setting up the stops is tedious, and involves stopping the crushing machine while the installation operations are being carried out. However, since the crushing machine is generally integrated into a more global process for processing the material, stopping the machine impacts the global process.

There is therefore a need for a new crushing and/or grinding machine that overcomes the above-mentioned disadvantages.

SUMMARY OF THE INVENTION

To this end, according to a first aspect, the invention proposes a crushing machine comprising:

a frame, a tank forming an internal grinding track. The tank is mounted on a chassis that can be moved in translation at least in a transverse plane with respect to the frame, a cone forming an external grinding track and placed inside the tank.

The machine also includes a device for vibrating the tank with respect to the frame in a transverse plane, so that material is crushed between the internal and external grinding tracks by the relative movement of the tank with respect to the cone.

The device for vibrating the tank includes at least two vibrators which are mounted on the chassis, each vibrator being rotated about a longitudinal axis of the chassis by a motor. Each motor drives independently of each other the vibrator with which it is associated. The device for vibrating the tank also includes a motor control system and a system for measuring the relative phase angle between the vibrators, so that the vibration device can take at least three positions:

a so-called zero position, in which the phase shift angle between the vibrators is such that the vibrations of the tank are of minimum amplitude;

a so-called maximum position, in which the phase shift angle between the vibrators is zero, so that the vibrations of the tank are of maximum amplitude;

at least one so-called intermediate position, in which the phase shift angle between the vibrators is such that the vibrations of the tank are of intermediate amplitude between the maximum and minimum amplitude, the control system being able to move the vibration device from one position to the other while maintaining the rotation of the vibrators.

The vibrations for crushing the material can thus be adjusted in line, without stopping the machine, depending on the grinding power that is required to crush the material. Thus, the machine operates continuously.

According to one embodiment, each motor is mounted on the frame and comprises a motor shaft extending longitudinally. Each vibrator is mounted on a vibrator shaft, a connection between the motor shaft and the corresponding vibrator shaft comprising a rigid coupling in the transverse plane, so that the vibrator shaft is driven in rotation by the motor shaft, and a flexible coupling in the longitudinal direction, so that the vibrator shaft can move in the longitudinal direction relative to the motor shaft over a determined maximum stroke.

The flexibility of the connection between the motor shaft and the vibrator shaft allows the machine to be preserved while ensuring an efficient transmission.

For example, the connection between the drive shaft and the vibrator shaft may include a connecting rod with a constant velocity transmission joint between the drive shaft and the vibrator shaft, and may also include an intermediate member between the connecting rod and the drive shaft. The intermediate member may include a strip of elastomeric material attached between two parts of a rigid body of the intermediate member. More precisely, a first part can be fixed to one end of the motor shaft and a second part can be fixed to one end of the connecting rod. One of the first and second parts may further comprise a longitudinal projecting pin cooperating with a longitudinal bore in the other of the first part and the second part in order to guide the movement of the vibrator shaft in the longitudinal direction with respect to the motor shaft.

This design is inexpensive to install and ensures the transmission between the motor shaft and the vibrator shaft in an efficient way.

According to one embodiment, each motor comprises a motor mode, in which the motor consumes energy to rotate the associated vibrator, and a generator mode, in which the motor generates energy by braking the associated vibrator. For this purpose, for example, the motor control system may comprise a device for recovering and storing at least a portion of the energy generated by each motor in generator mode. Alternatively or in combination, the motor control system may comprise a device for dissipating at least a portion of the energy generated by each motor in generator mode.

The recovered energy thus reduces the operating costs of the machine. The recovered energy can thus be used either to control the machine or to power other devices.

According to a second aspect, a crushing method using a crushing machine as presented above is proposed. The method then comprises the following steps:

setting the vibrating device to the zero position;

the determination by the control system of a grinding force as a function of at least one crushing parameter;

increasing the rotational speed of the vibrators up to a value that is determined by the grinding force;

setting the of the vibrators to their relative position with a phase shift angle between the vibrators that is determined by the grinding force;

feeding the machine with material to be crushed between the two grinding tracks.

The method also includes, the rotation of the vibrators being maintained:

detecting a change in at least one crushing parameter;

determining a new grinding force;

modifying at least the phase shift angle between the vibrators according to the new force.

According to one particular embodiment, a modified crushing parameter can be the grain size of the crushed material at the output of the crushing machine. Thus, by adjusting the grinding force in line, the granulometric characteristics of the material at the output of the machine can be adapted according to the requirements. Alternatively or in combination, a modified crushing parameter can be the grain size of the material that is fed to the crushing machine. A modification of the grain size of the material entering the crushing machine is commonly encountered. It is therefore particularly economically advantageous to adapt the grinding force to the grain size of the material to be crushed.

According to one embodiment, the crushing machine also comprises a sensor for the vibrations of the tank in the longitudinal direction, i. e. the vertical vibrations. The detection of a change in the crushing parameter may then comprise:

determining a reference spectrum for the longitudinal vibrations of the tank, comparing the reference spectrum with a spectrum measured by the vibration sensor, quantifying a difference between the reference spectrum and the measured spectrum if the quantified difference exceeds a threshold value, confirming the detection of a change in at least one crushing parameter of the material that is fed to the crushing machine.

Monitoring the vertical vibrations makes it possible in particular to monitor a machine failure, and to anticipate it in order to avoid breakage that would require stopping the machine for repairs over a long period of time.

According to one embodiment, the set-up in the starting position comprises the following steps:

the vibrators being stopped, registering an initial position of the vibrators in which the phase shift between the vibrators corresponds to the zero position of the vibrating device;

moving the vibrators;

rotating the vibrators until the vibrators are in their initial position.

This procedure of registering an initial position allows the machine to start faster and automatically. For example, when a failure has required the machine to be stopped, the machine can be restarted from the registered initial position automatically.

According to one embodiment, when a material supply cut-off occurs, the device for vibrating the tank is set to the zero position, in order to preserve the machine. As each vibrator is controlled independently of the others by a motor, the zero position is set very quickly, preserving the integrity of the machine.

According to one embodiment, when an electrical power cut occurs in motors, the method may comprise the following steps:

setting at least one motor into generator mode, the recovery and storage of at least a portion of the braking energy by the recovery and storage device;

setting the tank vibrating device to the zero position by using at least a portion of the energy recovered in the recovery and storage device in order to phase out the vibrators, maintaining the zero position until all vibrators have stopped rotating.

BRIEF DESCRIPTION OF THE DRAWINGS

Other effects and advantages will appear in the light of the description of embodiments of the invention together with the figures in which.

DETAILED DESCRIPTION OF THE PREFERRED EMBODIMENTS

Figure 1:
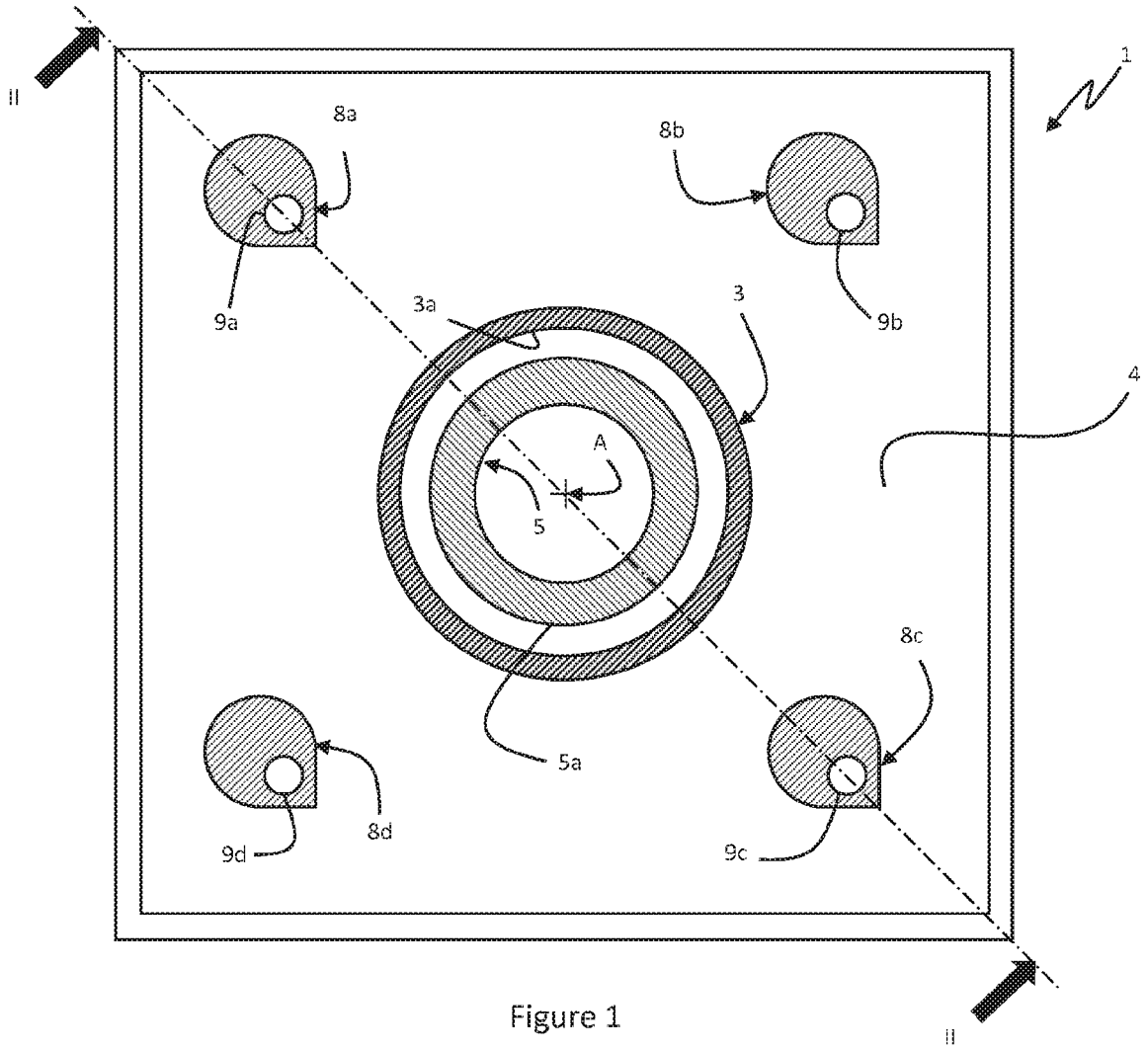
FIG. 1 is a cross-sectional view of a crushing machine according to one embodiment of the invention in which four vibrators are controlled by four independent motors.
Figure 2:
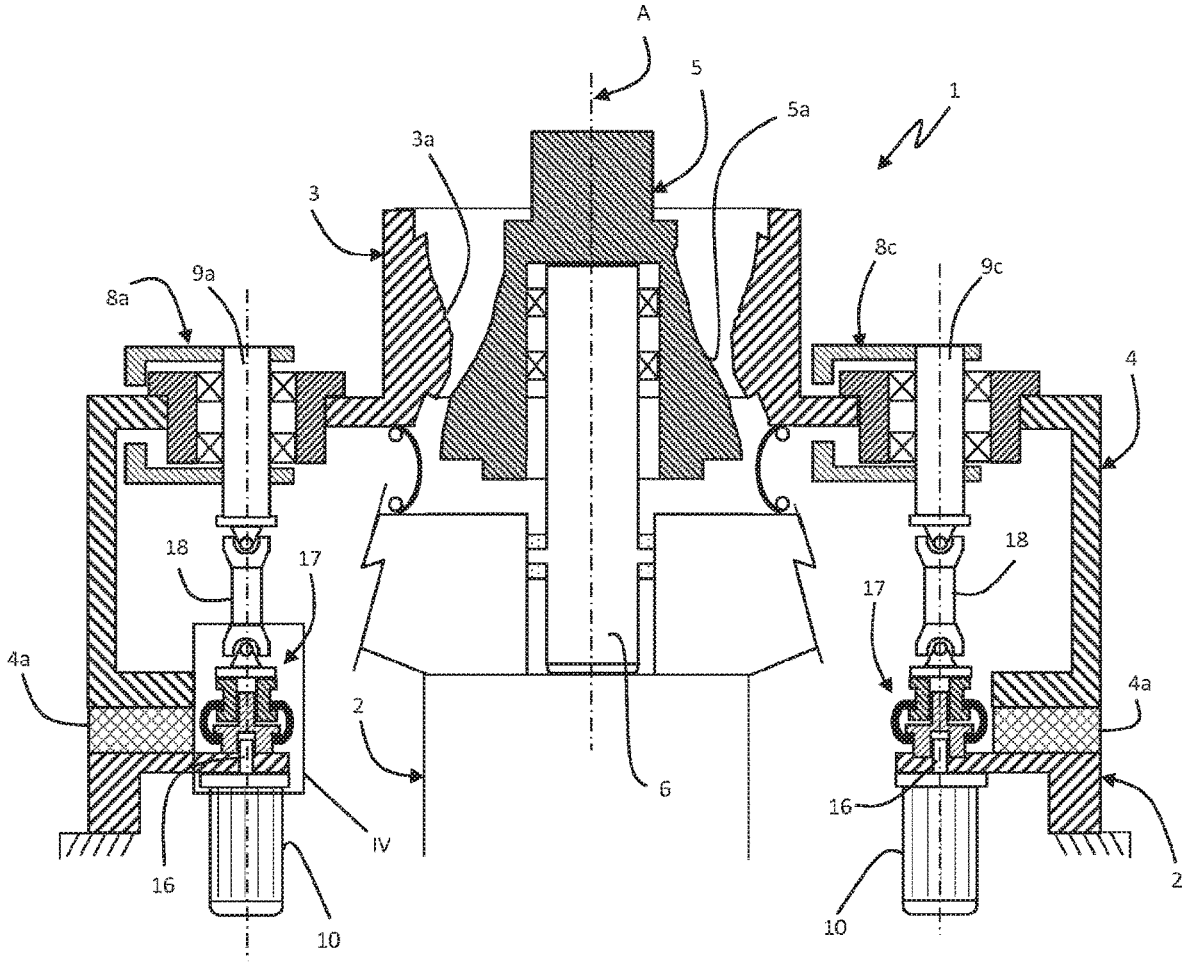
FIG. 2 is a view of the machine in FIG. 1 along the section line II-II.

In FIGS. 1 and 2, a vibration crushing machine 1 is shown. The machine 1 comprises in particular a frame 2, intended to rest on the ground.

The machine 1 also comprises a tank 3, the inner surface of which forms an internal grinding track 3*a*. The tank 3 is mounted on a chassis 4 that can be moved in translation with respect to the frame 2 at least in a transverse plane, which in practice is substantially the horizontal plane. For this purpose, the chassis 4 is mounted on the frame 2 by means of elastic studs 4*a*, which deform elastically both transversely and longitudinally to reduce the transmission of vibrations to the frame 2. A cone 5, whose outer surface is substantially complementary to that of the inner surface of the tank 3 and which constitutes an external grinding track 5*a*, is placed inside the tank 3. Preferably, the cone 5 is mounted on a shaft 6 extending along a longitudinal axis A, which in practice is substantially vertical, and supported by a secondary frame 2*a*. The secondary frame 2*a* is suspended from the chassis 4.

Figure 3:
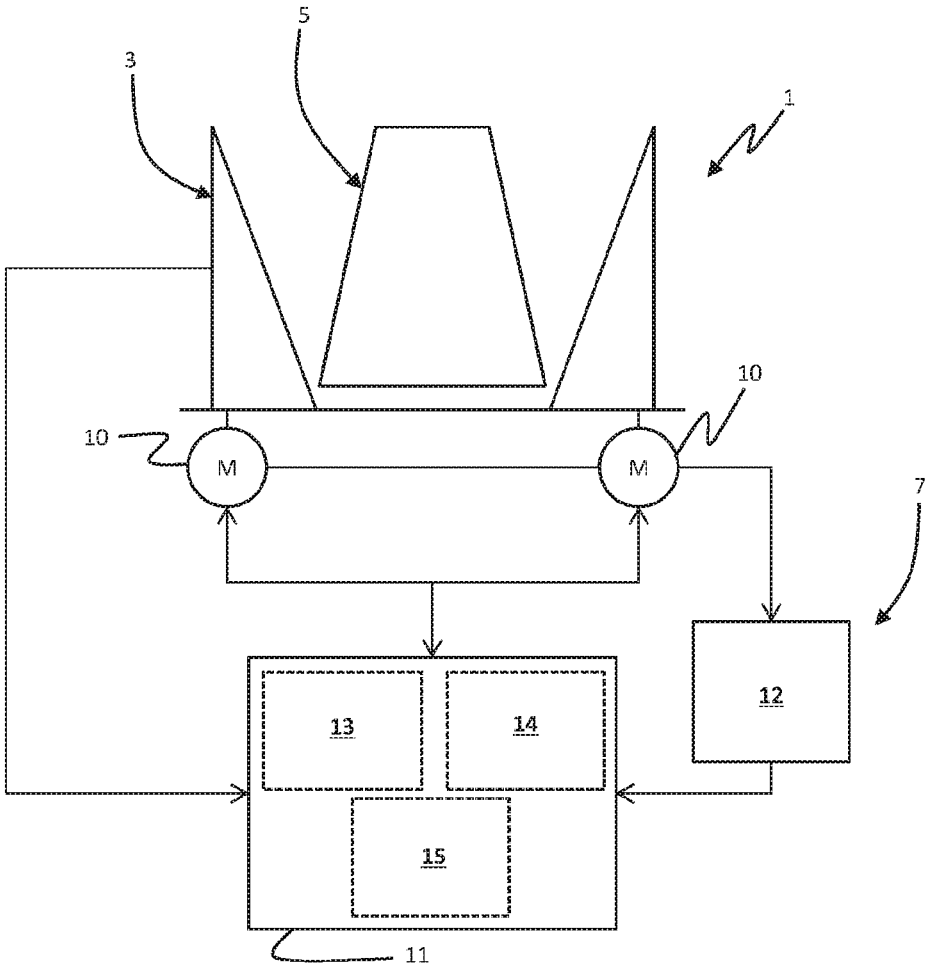
FIG. 3 is a schematic representation of one embodiment for carrying out the control of the machine in FIG. 1.

Finally, the machine 1 comprises a device 7 for vibrating the tank 3 with respect to the frame 2 in a transverse plane (FIG. 3). Thus, under the effect of the vibrating device 7, the tank 3 moves in the transverse plane with respect to the cone 5, so that material is crushed between the internal track 3*a* and the external track 5*a*. The vibrating device 7 comprises at least two vibrators.

According to an embodiment that is the one in the figures, the vibrating device 7 comprises four vibrators 8*a*, 8*b*, 8*c*, 8*d* distributed in a square on the chassis 4. Each vibrator 8*a*, 8*b*, 8*c*, 8*d* can be composed of two parts called unbalanced weights distributed on either side of a substantially transverse plane of the chassis 4, so that the vibrations of the tank 3 caused by the rotation of the vibrators 8*a*, 8*b*8*c*, 8*d* remain substantially in this transverse plane. Each vibrator 8*a*, 8*b*, 8*c*, 8*d* is fixed on a shaft 9*a*, 9*b*, 9*c*, 9*d* with a vibrator having a longitudinal axis that is driven in rotation with respect to the chassis 4 by a motor 10, whose motors 10 of the shafts 9*a*, 9*b* with vibrator are visible in FIG. 2. Thus, when the vibrators are rotated, the tank 3 is vibrated and describes a circular translation movement in a transverse plane. In general, the vibrating device 7 comprises at least two vibrators, which are distributed evenly about the longitudinal axis A, in order to generate vibrations, mainly or exclusively in the transverse plane, so that the energy consumed by the machine is optimally used to crush the material between the internal grinding track 4*a* and the external grinding track 5*a*. Particular measures may be taken in order to reduce longitudinal vibrations, that is to say in practice vertical vibrations. For example, the vibrators are identical to each other, and are arranged at equidistance from the longitudinal axis A and at equidistance from each other. When the vibrators are not identical, the distance to the longitudinal axis A and the distance between each other can be adjusted as a consequence.

Each motor 10 drives the corresponding vibrator independently of the other vibrators. More specifically, each motor 10 controls the position and speed of the corresponding vibrator. As it will be explained later on, each motor 10 is preferably a reversible motor, in other words it includes a motor mode, in which it consumes energy to rotate the corresponding vibrator, and a generator mode in which it generates energy by braking the corresponding vibrator.

More specifically, the vibrating device 7 includes a system 11 for controlling the motors 10 and a system 12 for measuring the relative phase shift between the vibrators 8*a*, 8*b*, 8*c*, 8*d*, that is to say the relative angle between the vibrators 8*a*, 8*b*, 8*c*, 8*d*, so that the vibration device 7 can take at least three positions:

a so-called zero position, in which the phase shift angle between the vibrators 8*a*, 8*b*, 8*c*, 8*d* is such that the vibrations of the tank 3 are of minimal or even zero amplitude;

a so-called maximum position, in which the phase shift angle between the vibrators 8*a*, 8*b*, 8*c*, 8*d* is zero, so that the vibrations of the tank 3 are of maximum amplitude;

at least one so-called intermediate position, in which the phase shift angle between the vibrators 8*a*, 8*b*, 8*c*, 8*d* is such that the vibrations of the tank 3 are of intermediate amplitude between the maximum amplitude and the minimum amplitude.

In practice, the vibration device 7 can have a multitude of intermediate positions, in order to adjust the amplitude of the vibrations according to the required grinding power.

According to the example shown in the figures, that is to say with four vibrators 8*a*, 8*b*, 8*c*, 8*d*, the phase shift of the vibrators is carried out two by two. Thus, in the zero position, the diagonally opposed vibrators 8*a*, 8*c* are in phase with each other, and also the diagonally opposed vibrators 8*b*, 8*d* are in phase with each other, while the vibrators 8*a*, 8*c* are in phase opposition with the vibrators 8*b*, 8*d*, that is to say the phase shift angle is approximately 180°. In the maximum position, the four vibrators 8*a*, 8*b*, 8*c*, 8*d* are in phase with each other. Finally, in the intermediate position, the vibrators 8*a*, 8*c* are out of phase by an angle of 180° with respect to the vibrators 8*b*, 8*d*.

More specifically, each vibrator 8*a*, 8*b*, 8*c*, 8*d* can be associated with a position sensor, making it possible to know at any time the position of each of the vibrators 8*a*, 8*b*, 8*c*, 8*d*.

The control system 11 is thus able to switch the vibrating device 7 from one position to the other while maintaining the rotation of the vibrators. Indeed, thanks in particular to the independence of the motors 10, at any time, the position of each vibrator, its rotation speed, and its phase shift with respect to the other vibrators are known and can be regulated in line, without it being necessary for the machine 1 to be stopped.

For this purpose, the control system includes a computer 13 which, based on the knowledge of the speed and position of each vibrator and the phase shift between the vibrators 8*a*, 8*b*, 8*c*, 8*d*, allows to know at any time the amplitude of the vibrations of the tank 3. By comparing the calculated value with a target value, the vibrating device 7 can regulate the phase shift between vibrators 8*a*, 8*b*, 8*c*, 8*d* in order to regulate the amplitude of the vibrations of the tank 3 at any time, and thus to regulate the grinding force. In addition, the control system can also regulate the speed of rotation of the vibrators in order to regulate the grinding power.

Thus, the intermediate position does not depend on the mechanical installation, but can be adjusted in line, without stopping the operation of the machine 1, by the control system 11 of the motors 10 acting directly on the motors. In addition, thanks to the use of the motors 10 which are each associated with a vibrator 8*a*, 8*b*, 8*c*, 8*d*, the position of each vibrator 8*a*, 8*b*, 8*c*, 8*d* is held with great reliability over a period of time that can range from a few minutes to several hours. For example, the control system 11 makes it possible to connect the motors 10 via a load sharing system, in order to ensure a synchronized control of the motors 10 and the vibrators 8*a*, 8*b*, 8*c*, 8*d*.

Thanks to this new design for a crushing machine 1 in which the vibrators 8*a*, 8*b*, 8*c*, 8*d* are each controlled by a motor 10 independently of each other, the machine 1 makes it possible to adapt the grinding force based on the characteristics of the incoming material and on the characteristics that are targeted for the material that is output from the machine 1.

Thus, to crush material, the vibrating device 7 is first set to the zero position. An initial grinding power can be determined by the computer 13 according to at least one crushing parameter. The initial grinding power determines an initial rotational speed and an initial phase shift of the vibrators 8*a*, 8*b*, 8*c*, 8*d*, this initial phase shift being possibly corresponding to the maximum position and then to an intermediate position. The control system then gradually increases the rotational speed of the vibrators 8*a*, 8*b*, 8*c*, 8*d* until it reaches the initial value. With the vibration device 7 being in the zero position, the tank 3 has little or no transverse movement with respect to the cone 5. Thus, during the increase in rotation speed, it is avoided to pass through harmonics frequencies of the machine 1 that could degrade it. Then, the control system 11 moves the vibrators so as to obtain the determined initial phase shift, and therefore the initial grinding power.

As long as the crushing parameters are not modified, the grinding power can be maintained substantially equal to the initial grinding power: the rotational speed of the vibrators and the phase shift are maintained, with increased reliability thanks to the use of the motors 10 which are each associated with a vibrator 8*a*, 8*b*, 8*c*, 8*d*.

However, it may happen that a crushing parameter is modified during the supply of the material.

Crushing parameter refers to any parameter that can influence the characteristics of the material at the output of the crushing machine 1. This includes, but is not limited to, the grain size of the pellets, in other words the size, hardness, shape, and porosity of the pellets, the density of the input material, the target grain size of the pellets at the outlet of the material, and the material flow rate. In practice, the grain size of the input material, and in particular the size of the pellets, in relation to the target grain size, and in particular the size of the pellets, of the output material are the most frequently used crushing parameters.

By detecting the modification of a crushing parameter, a new grinding power may be calculated by the computer 13, and the phase shift angle, and/or rotational speed, of the vibrators may be modified to obtain the new grinding power, while maintaining the rotation of the vibrators. Here again, the phase shift angle of the vibrators may correspond to the maximum position or to an intermediate position.

Indeed, the grinding power is directly related to the amplitude of the vibrations of the tank 3, which is determined by the phase shift between the vibrators. More specifically, it is the grinding force that depends directly on the phase shift of the vibrators.

However, the required grinding power can be determined in particular according to the characteristics of the input material and the characteristics that are targeted for the output material. For example, the larger the difference in size between the pellets of the output material and the input material, the greater the grinding power must be.

An example of application relates to mineral processing, in other words the crushing of ores. Depending on the needs, it may happen that the output material has a proportion of pellets with a size that is smaller than a required size, also known as fines, that is too high. Indeed, fine particles can be detrimental to downstream processing processes. Thanks to the new machine 1 which is presented here, the grinding power is adjusted in order to prevent the production of fines.

In general, thanks to the crushing machine 1 designed in this way, and unlike the state-of-the-art machines, it is not necessary to stop the crushing machine 1 in order to change the phase shift between the vibrators 8*a*, 8*b*, 8*c*, 8*d* and to maintain a new grinding power that is different from that initially determined when the machine 1 is started.

The modification of a crushing parameter can be done upstream of the machine 1, for example by directly measuring the characteristics of the input material, or downstream of the machine 1, for example by measuring the characteristics of the output material. According to one embodiment, the machine 1 also comprises a sensor for the longitudinal vibrations of the tank 3. By comparing the spectrum of the longitudinal vibrations measured by the sensor with a reference spectrum, it is possible to detect a change in a crushing parameter. A difference between the measured spectrum and the reference spectrum is quantified. This may be, for example, a difference in amplitude, frequency, or time shift. If the quantified difference exceeds a threshold value, the detection of a change in a crushing parameter can be confirmed, for example by sending a signal to the vibrating device 7, in order to regulate the phase shift of the vibrators accordingly.

Indeed, there may be situations in which the grinding power of the machine 1 is inadequate. For example, the power may be insufficient, so that the pellets of the input material are not crushed, and cause a blockage. It may also happen that the grinding power is too high, so that the external track 5*za* of the cone 5 comes into contact with the internal track 3*a* of the tank 3. In such situations, unintended longitudinal vibrations occur, indicating that the grinding power must be adjusted.

The machine 1 thus formed can be more responsive to changes in the crushing parameters than the state-of-the-art crushing machines. In particular, when a material supply cut-off occurs, it is quickly detected, and, thanks to the motors 10, the vibrating device 7 can quickly switch to the zero position, in such a way that the tank 3 does not come in contact with the cone 5 and the grinding tracks 3*a*, 5*a* are not damaged. The reaction time is in the order of a few seconds between the detection of the material supply cut-off and the switch to the zero position, whereas in the state-of-the-art of pulley technology, the reaction time is of several tens of seconds.

The position of the vibrators is also precise, with an angular offset that is usually less than 1°. In addition, since the position and speed of the vibrators 8*a*, 8*b*, 8*c*, 8*d* and 8*c* are known at all times, it is easy to set up predictive maintenance: when the power developed by one vibrator deviates too far from a reference power or from that of other vibrators, a maintenance signal may be generated indicating that an intervention, for example a lubrication operation, a diagnosis of the bearings, or a visual inspection, must be carried out.

Figure 4:
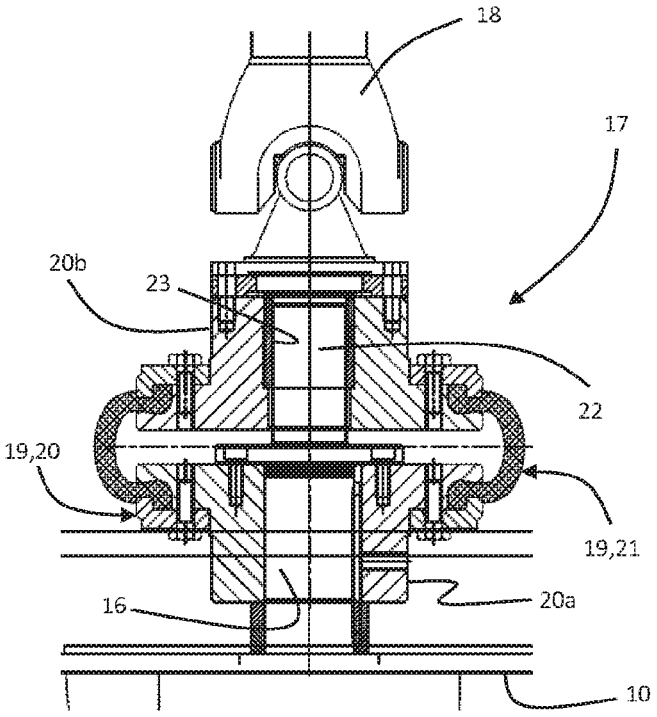
FIG. 4 is a detailed view IV-IV of FIG. 2.

According to one embodiment illustrated in particular in FIG. 4, the position sensor of each vibrator is of an encoder type. An operator places the vibrators 8*a*, 8*b*, 8*c*, 8*d* in an initial position in which the phase shift between the vibrators 8*a*, 8*b*, 8*c*, 8*d* corresponds to the zero position of the vibrating device 7. Each encoder then registers the position of the associated vibrator. Thus, after the vibrators 8*a*, 8*b*, 8*c*, 8*d* have been moved away from their initial position, it is required, in order to start the machine 1, to return the vibration device 7 to the zero position, so as to increase the speed to the speed that is determined by the grinding power required without generating any vibrations. To this end, the motors 10 rotate the vibrators 8*a*, 8*b*, 8*c*, 8*d* until each vibrator 8*a*, 8*b*, 8*c*, 8*d* is returned to its initial position, prior to increasing their rotational speed. Thus, the machine 1 can be stopped abruptly, the vibrators 8*a*, 8*b*, 8*c*, 8*d* being in a position with any relative phase shift; the restarting of the machine 1 is always done with the vibrating device 7 being in the zero position.

As mentioned above, the motors 10 may be of a reversible type. Thus, according to one embodiment, the motor control system 10 comprises a device 14 for recovering at least a portion of the energy that is generated by each motor 10 in the generator mode. Thus, when a power failure occurs, at least one motor 10, in practice all motors 10, switch to the generator mode. The recovered energy can then be used by the control system 10 in order to set the vibrating device 7 to the zero position, so that the vibrations in the tank 3 are almost non-existent. Thus, the rotational speed of the vibrators 8*a*, 8*b*, 8*c*, 8*d* gradually decreases, the vibrating device 7 being maintained in the zero position, without passing through the harmonics frequencies of the machine 1 which could degrade it.

According to one embodiment, the energy that is recovered by the recovery device may be stored.

According to another embodiment, the energy that is recovered by the recovery device is directly used by one or more motors 10. More specifically, during the transient phases including the phase shift changes between the vibrators 8*a*, 8*b*, 8*c*, 8*d*, as the motors 10 are connected to a load sharing system, the electrical energy generated by the motor(s) that are switched to the generator mode may then be directly transmitted to the motor(s) in the drive mode. The sharing system thus makes it possible to distribute the power between the motors 10 during the transient phases involving very large power differences between the motors 10.

The control system 11 may also potentially include a device 15 for dissipating at least a portion of the energy that is generated by each motor in the generator mode, allowing excess energy to be dissipated and preventing an overload on the load sharing system in the event of rapid braking, for example.

According to one embodiment, each motor 10 is mounted on the frame 2 and comprises a motor shaft 16, which extends longitudinally, and is connected to the corresponding vibrator shaft 9*a*, 9*b*, 9*c*, 9*d* through a connection 17 which drives the rotating vibrator shaft 9*a*, 9*b*, 9*c*, 9*d*. For this purpose, each vibrator shaft 9*a*, 9*b*, 9*c*, 9*d* being mounted in rotation about an axis which is parallel to the longitudinal axis of the chassis 4, the connection 17 between the motor shaft 16 and the corresponding vibrator shaft 9*a*, 9*b*, 9*c*, 9*d* comprises a rigid coupling in the transverse plane. However, any longitudinal vibrations of the chassis 4 carrying the tank 3 can degrade the connection between the shafts. To avoid this, the connection also comprises a flexible coupling in the longitudinal direction, so that the vibrator shaft 9*a*, 9*b*, 9*c*, 9*d* can move in the longitudinal direction relative to the motor shaft 16 over a specified maximum stroke. This arrangement also allows each motor 10 to be arranged substantially in the longitudinal alignment of one of the vibrators 8*a*, 8*b*, 8*c*, 8*d*.

For example, the connection 17 between the motor shaft 16 and the corresponding vibrator shaft 9*a*, 9*b*, 9*c*, 9*d* comprises a connecting rod 18 with a constant velocity transmission joint. It is for example a connecting rod 18 with a double cardan joint. In addition, the connection 17 comprises an intermediate member 19 between one end of the connecting rod 18, for example the end on the motor side 10. This intermediate member consists in particular of a rigid body 20, for example metallic, in two parts 20*a*, 20*b*, and a strip 21 made of elastomeric material which is fixed between the two parts 20*a*, 20*b* of the rigid body 20. More precisely, the strip 21 has an annular shape, each of its free edges being rigidly fixed to one of the parts 20*a*, 20*b* of the rigid body 20. A first part 20*a* of the rigid body 20 is rigidly fixed to one end of the motor shaft 10, and the second part 20*b* is fixed to the motor end 10 of the connecting rod 18. The elastomeric strip 21 is elastic enough to deform longitudinally, allowing a relative longitudinal movement over a given stroke between the motor shaft 10 and the corresponding vibrator shaft 9*a*, 9*b*, 9*c*, 9*d*. In order to guide this longitudinal displacement, one of the two parts, for example the first part 20*a*, comprises a longitudinally projecting pin 22, and the other part, for example the second part 20*b*, comprises a longitudinal bore 23, which is complementary to the pin 22, so as to allow the pin 22 to slide in the bore 23 with guidance. The pin 22 may be attached by rigid fixing to the first part 20*a*, or be monoblock with the first part 20*a*. The second part 20*b* is for example made of steel, and a self-lubricated bronze ring is pressed into the bore 23.

The connection 17 thus allows flexibility in the transmission of rotation from the motor shafts 16 to the vibrator shafts 9*a*, 9*b*, 9*b*, 9*c*, 9*d*, which absorbs the vibrations of the tank 3 with respect to the frame 2. The cooperation between the pin 22 and the bore 23 makes it possible to prevent transverse deflections that could damage the mechanical stability of the connection 17.

The invention claimed is:

1. A crushing machine (1), comprising:

a frame (2);

a tank (3) forming an internal grinding track (3*a*), the tank being mounted on a chassis (4) which is movable in translation in at least a plane transverse with respect to the frame (2);

a cone (5) forming an external grinding track (5*a*) and placed inside the tank (3); and a device (7) for vibrating the tank (3) with respect to the frame (2) in a transverse plane, so that the material is crushed between the internal grinding track (3*a*) and the external grinding track (5*a*) through the relative movement of the tank (3) with respect to the cone (5), wherein the device (7) for vibrating the tank (3) comprises at least two vibrators which are mounted on the chassis (4), each vibrator of the at least two vibrators being rotated about a longitudinal axis of the chassis by a motor (10), each motor (10) driving a vibrator of the at least two vibrators with which the motor is associated independently from one another, the device (7) for vibrating the tank (3) further comprising a system (11) for controlling the motors (10), and a system (12) for measuring a relative phase shift angle between the at least two vibrators, so that the vibration device (7) can take any of at least three positions:

a zero position, in which the phase shift angle between the at least two vibrators is such that the vibrations of the tank (3) are of minimal amplitude, a maximum position, in which the phase shift angle between the at least two vibrators is zero, so that the vibrations of the tank (3) are of maximum amplitude, at least one intermediate position, in which the phase shift angle between the at least two vibrators is such that the vibrations of the tank are of intermediate amplitude between the maximum amplitude and the minimum amplitude, wherein the control system (11) is configured to switch the vibration device from one position of the at least three positions to an other of the at least three positions while maintaining rotation of the vibrators, and wherein, when the vibrators are rotated, the tank is vibrated and describes a circular translation movement in said transverse plane.

2. The machine (1) according to claim 1, wherein each motor (10) is mounted on the frame (2) and comprises a longitudinally extending motor shaft (16), and wherein each vibrator of the at least two vibrators is mounted on a vibrator shaft, a connection (17) between the motor shaft (16) and a corresponding vibrator shaft comprising a rigid coupling in a transversal plane, so that the vibrator shaft is driven in rotation by the motor shaft (16) and a flexible coupling in a longitudinal direction, so that the vibrator shaft is able to move in the longitudinal direction with respect to the motor shaft (16) over a specified maximum stroke.

3. The machine (1) according to claim 2, wherein each motor (10) comprises a motor mode, in which the motor (10) consumes energy in order to rotate the associated vibrator, and a generator mode, in which the motor (10) generates energy by braking the associated vibrator.

4. A crushing method involving the use of a crushing machine (1) according to claim 2, comprising:

setting the vibrating device (7) to the zero position;

determining, by the control system (11), a grinding force as a function of at least one crushing parameter;

increasing the rotational speed of the vibrators up to a value that is determined by the grinding force;

setting the vibrators to their relative position with a phase shift angle between the vibrators that is determined by the grinding force;

feeding the machine (1) with the material to be crushed between the two grinding tracks (3*a*, 5*a*);

detecting a change in at least one crushing parameter;

determining a new grinding force; and modifying at least the phase shift angle between the vibrators as a function of the new grinding force while maintaining the rotation of the vibrators.

5. The machine (1) according to claim 2, wherein the connection (17) between the motor shaft (16) and the vibrator shaft comprises a connecting rod (18) having a constant velocity transmission joint between the motor shaft (16) and the vibrator shaft, and wherein the crushing machine further comprises an intermediate member (19) between the connecting rod (18) and the motor shaft (16), the intermediate member (19) comprising a strip (21) of elastomeric material which is fixed between two parts (20*a*, 20*b*) of a rigid body (20) of the intermediate member (19), a first (20*a*) part being fixed to one end of the motor shaft (16) and a second part (20*b*) being fixed to one end of the connecting rod (18), one of the first part (20*a*) and the second part (20*b*) further comprising a longitudinally projecting pin (22) which cooperates with a longitudinal bore (23) in an other of the first part (20*a*) and the second part (20*b*) so as to guide movement of the vibrator shaft in the longitudinal direction with respect to the motor shaft (16).

6. The machine (1) according to claim 5, wherein each motor (10) comprises a motor mode, in which the motor (10) consumes energy in order to rotate the associated vibrator, and a generator mode, in which the motor (10) generates energy by braking the associated vibrator.

7. A crushing method involving the use of a crushing machine (1) according to claim 5, comprising:

setting the vibrating device (7) to the zero position;

determining, by the control system (11), a grinding force as a function of at least one crushing parameter;

increasing the rotational speed of the vibrators up to a value that is determined by the grinding force;

setting the vibrators to their relative position with a phase shift angle between the vibrators that is determined by the grinding force;

feeding the machine (1) with the material to be crushed between the two grinding tracks (3*a*, 5*a*);

detecting a change in at least one crushing parameter;

determining a new grinding force; and modifying at least the phase shift angle between the vibrators as a function of the new grinding force while maintaining the rotation of the vibrators.

8. The machine (1) according to claim 1, wherein each motor (10) comprises a motor mode, in which the motor (10) consumes energy in order to rotate the associated vibrator, and a generator mode, in which the motor (10) generates energy by braking the associated vibrator.

9. The machine (1) according to claim 8, wherein the motor control system (11) comprises a device (14) for recovering at least a portion of the energy generated by each motor (10) in the generator mode.

10. The machine (1) according to claim 9, wherein the motor control system (11) comprises a device (15) for dissipating at least a portion of the energy generated by each motor (10) in the generator mode.

11. The machine (1) according to claim 8, wherein the motor control system (11) comprises a device (15) for dissipating at least a portion of the energy generated by each motor (10) in the generator mode.

12. A crushing method involving the use of a crushing machine (1) according to claim 8, comprising:

setting the vibrating device (7) to the zero position;

determining, by the control system (11), a grinding force as a function of at least one crushing parameter;

increasing the rotational speed of the vibrators up to a value that is determined by the grinding force;

setting the vibrators to their relative position with a phase shift angle between the vibrators that is determined by the grinding force;

feeding the machine (1) with the material to be crushed between the two grinding tracks (3*a*, 5*a*);

detecting a change in at least one crushing parameter;

determining a new grinding force; and modifying at least the phase shift angle between the vibrators as a function of the new grinding force while maintaining the rotation of the vibrators.

13. A crushing method involving the use of a crushing machine (1) according to claim 9, comprising:

setting the vibrating device (7) to the zero position;

determining, by the control system (11), a grinding force as a function of at least one crushing parameter;

increasing the rotational speed of the vibrators up to a value that is determined by the grinding force;

setting the vibrators to their relative position with a phase shift angle between the vibrators that is determined by the grinding force;

feeding the machine (1) with the material to be crushed between the two grinding tracks (3*a*, 5*a*);

detecting a change in at least one crushing parameter;

determining a new grinding force; and modifying at least the phase shift angle between the vibrators as a function of the new grinding force while maintaining the rotation of the vibrators.

14. A crushing method that uses the crushing machine (1) according to claim 1, comprising:

setting the vibrating device (7) to the zero position;

determining, by the control system (11), a grinding force as a function of at least one crushing parameter;

increasing the rotational speed of the vibrators up to a value that is determined by the grinding force;

setting the vibrators to their relative position with a phase shift angle between the vibrators that is determined by the grinding force;

feeding the machine (1) with the material to be crushed between the two grinding tracks (3*a*, 5*a*);

detecting a change in at least one crushing parameter;

determining a new grinding force; and modifying at least the phase shift angle between the vibrators as a function of the new grinding force while maintaining the rotation of the vibrators, wherein, when the vibrators are rotated, the tank is vibrated and describes a circular translation movement in said transverse plane.

15. The method according to claim 14, wherein a modified crushing parameter is a grain size of the crushed material at an output of the crushing machine (1).

16. The method according to claim 14, wherein a modified crushing parameter is a grain size of the material that is fed to the crushing machine (1).

17. The method according to claim 16, wherein the crushing machine (1) further comprises:

a vibration sensor for the tank (3) in the longitudinal direction, and wherein the detection of a change in the crushing parameter comprises:

determining a reference spectrum for the longitudinal vibrations of the tank (3), comparing the reference spectrum with a spectrum measured by the vibration sensor, quantifying a difference between the reference spectrum and the measured spectrum, and if the quantified difference exceeds a threshold value, confirming the detection of a change in at least one crushing parameter for the material that is fed to the crushing machine (1).

18. The method according to claim 17, wherein a starting position comprises:

the vibrators being at rest, registering an initial position of the vibrators in which the phase shift between the vibrators corresponds to the zero position of the vibrating device (7);

moving the vibrators; and rotating the vibrators until the vibrators are in their initial position.

19. The method according to claim 14, wherein when a material supply interruption occurs, the device (7) for vibrating the tank (3) is switched to the zero position.

20. The method according to claim 14, wherein each motor (10) comprises a motor mode, in which the motor (10) consumes energy in order to rotate the associated vibrator, and a generator mode, in which the motor (10) generates energy by braking the associated vibrator, and wherein when an electrical power cut occurs in the motors (10), the following further steps take place:

setting at least one motor (10) into generator mode;

recovery and storage of at least a portion of the braking energy by the recovery device (14);

setting the vibrating device (7) of the tank (3) to the zero position by using at least a portion of the energy recovered in the recovery device (14) so as to phase out the vibrators; and maintaining the zero position until the rotation of all the vibrators is stopped.

* * * * *